United States Patent [19]

Teramura et al.

[11] Patent Number: 4,500,476

[45] Date of Patent: Feb. 19, 1985

[54] VARIABLE VENTURI TYPE CARBURETOR

[75] Inventors: Mitsuyoshi Teramura; Masatami Takimoto, both of Toyota; Norihiko Nakamura, Mishima; Takaaki Itoh, Mishima; Takashi Katou, Mishima; Yukinori Isoya, Nagoya, all of Japan

[73] Assignees: Toyota Jidosha Kabushiki Kaisha, Toyota; Aisan Industry Co., Ltd., Obu, both of Japan

[21] Appl. No.: 428,034

[22] Filed: Sep. 29, 1982

[30] Foreign Application Priority Data

Dec. 24, 1981 [JP] Japan ..... 56-207989

[51] Int. Cl.[3] ..... F02M 9/06

[52] U.S. Cl. ..... 261/44 C; 261/DIG. 81

[58] Field of Search ..... 261/DIG. 81, 44 C

[56] References Cited

U.S. PATENT DOCUMENTS

| | | | |
|---|---|---|---|
| 1,444,222 | 2/1923 | Trego | 261/44 B |
| 3,245,666 | 4/1966 | Marsee | 261/DIG. 81 |
| 3,618,578 | 11/1971 | Swatman et al. | 261/44 C |
| 4,289,715 | 9/1981 | Ito et al. | 261/44 C |
| 4,369,749 | 1/1983 | Sugi | 261/DIG. 81 |

FOREIGN PATENT DOCUMENTS

| | | | |
|---|---|---|---|
| 2625978 | 12/1976 | Fed. Rep. of Germany | 261/44 C |
| 54-30321 | 3/1979 | Japan | 261/DIG. 81 |

*Primary Examiner*—Tim Miles

*Attorney, Agent, or Firm*—Finnegan, Henderson, Farabow, Garrett & Dunner

[57] ABSTRACT

In a variable venturi type carburetor having a slow speed system, a fuel vapor conduit is provided, an inlet of which is open to a main fuel passage, an outlet of which is open to an intake passage. Fuel vapor occurring in the main fuel passage is carried through the fuel vapor conduit, so as not to be introduced into a slow fuel passage; thereby, the engine is rotated stably with a relatively lean air-fuel ratio.

2 Claims, 3 Drawing Figures

VARIABLE VENTURI TYPE CARBURETOR

BACKGROUND OF THE INVENTION

The present invention relates to a variable-venturi-type carburetor in an internal combustion engine, especially to a carburetor having a slow speed system.

Variable-venturi-type carburetors having a slow speed system are known. Such a carburetor has a suction piston movable in the intake passage in response to a change in the amount of air flowing within the intake passage for varying the cross-sectional flow area of the intake passage, and has a main fuel metering system comprising a metering needle fixed onto the suction piston and a metering jet arranged in one end of a main fuel passage which extends along the longitudinal axis of the needle to allow the needle to enter therein. Further, this type carburetor has a slow speed system comprising a slow fuel passage, an inlet of which is open to the main fuel passage and an outlet of which is open to the intake passage of the carburetor.

For obtaining an economical, fuel-consuming engine, especially during engine idling, it is necessary that the inner diameter of the slow fuel passage be relatively small. However, the atmospheric temperature in the area of the carburetor is high, and the temperature of the carburetor increases when the engine is caused to idle after being driven at a high load. The fuel is vaporised in the main fuel passage during such conditions. If fuel vapor is introduced into the relatively small slow fuel passage during engine idling, the air-fuel ratio varies in step pulses. This causes the engine revolution to be unstable and the engine may stall.

SUMMARY OF THE INVENTION

It is an object of the present invention to provide a variable-venturi-type carburetor which can give stable engine revolutions with a relatively lean air-fuel ratio.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

The above object is attained by a variable-venturi-type carburetor, according to the present invention, having an intake passage therethrough, a suction piston movable in the intake passage in response to a change in the amount of air flowing within the intake passage for varying the flow area of the intake passage; a substantially horizontally extending main fuel passage having a first end and a second blind end, said second blind end located at a position in said main fuel passage opposite to said first end; a metering jet arranged adjacent to the first end of said main fuel passage for interconnecting the main fuel passage to the intake passage; a slow fuel passage having a fuel inlet which is open to the main fuel passage near said metering jet, said slow fuel passage having a fuel outlet which is open to the intake passage; and a metering needle fixed onto the suction piston and extending into the metering jet for metering fuel fed into the intake passage from the main fuel passage; said main fuel passage having a vertically enlarged portion formed between the inlet of the slow fuel passage and the second blind end; a fuel vapor conduit having a fuel vapor inlet which is open to the main fuel passage at said vertically enlarged portion, said fuel vapor conduit having a fuel vapor outlet which is open to the intake passage.

Advantageously, said outlet of the fuel vapor conduit is open to the intake passage at a position where the flow area is varied due to the movement of the suction piston.

Also advantageously, an upwardly oriented T-shaped inlet port for the vapor fuel passage is provided in the carburetor body, one lateral port of the inlet port being connected to the fuel vapor conduit, the other lateral port being connected to atmospheric pressure.

With this arrangement, fuel vapors occurring in the main fuel passage are not introduced into the slow fuel passage, but are carried to the intake passage through the fuel vapor conduit; thus, it is possible to set a lean air-fuel ratio for a slow speed system in which the engine rotates stably during idling. This is further advantageous because it provides an engine that consumes less fuel and has a better controlled emission.

The invention will now be described in more detail with reference to the accompaning drawings which illustrate the preferred embodiment of the invention, in which.

DESCRIPTION OF A PREFERRED EMBODIMENT

Figure 1:
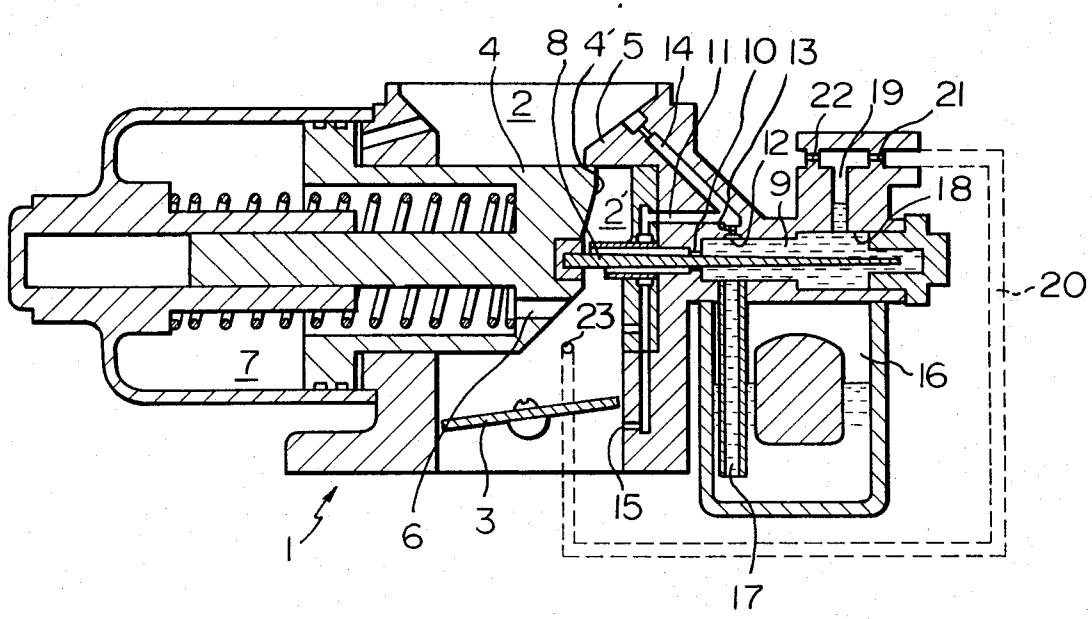
FIG. 1 is a sectional view of the preferred embodiment of a variable-venturi-type carburetor, constructed according to the invention, taken along an axis of the suction piston.

In FIG. 1, a down-draft, variable-venturi-type carburetor is shown, having a carburetor body 1. In the illustrated carburetor, an intake passage 2 extends vertically through the carburetor body 1 and air flows downwardly therethrough. A throttle valve 3 is provided in the intake passage 2, and a suction piston 4 is arranged horizontally to project into the intake passage 2. A venturi section 2' is formed between a leading edge 4' of the suction piston 4 and an inward elevation 5 of the body 1. The cross-sectional flow area in the venturi section 2' varies according to the horizontal movement of the suction piston 4. To cause the horizontal movement of the suction piston 4, a suction port 6 is provided in the suction piston 4 between a vacuum chamber 7, provided on the opposite side of piston 4, and the leading edge 4' of the suction piston 4. A vacuum in the venturi section 2' is introduced into the vacuum chamber 7 through the suction port 6, so that the suction piston 4 may move to the right or left, according to FIG. 1, in response to a change of the vacuum pressure in the venturi section, that is, a change of the amount of air flowing within the intake passage 2. This construction and operation is well known in the art.

A metering needle 8 is fixed horizontally onto the suction piston 4, with the longitudinal axis of the needle 8 coinciding with that of the suction piston 4. The needle 8 moves together with the suction piston 4, to the right or left, according to FIG. 1. A main fuel passage 9 extends axially in a horizontal direction, the axis of which coincides with that of the needle 8, so that the needle 8 may enter into the main fuel passage 9. A metering jet 10 is formed at a first end of the axially extending main fuel passage 9, which metering jet 10 interconnects the main fuel passage 9 to the intake passage 2 and meters the amount of fuel to be fed to the intake passage 2 in cooperation with the metering needle 8. A second end of the axially extending main fuel passage is formed as a blind end at a position opposite to the first end.

The illustrated carburetor has a slow speed system comprising a slow fuel passage 11. An inlet 12 of the slow fuel passage 11 is open to the main fuel passage 9 near the metering jet 10. A slow jet 13 is provided in the slow fuel passage 11, and the slow fuel passage 11 is connected with an air bleed passage 14. An outlet 15 of the slow fuel passage 11 is open to the intake passage 2 at a position on the downstream side of the throttle valve 3.

The numeral 16 shows a float chamber, and fuel is fed from the float chamber 16 to the venturi section 2' through a pipe 17 and the metering jet 10 during a certain engine condition, or is fed to the intake passage 2 through the pipe 17 and the slow fuel passage 11 at another engine condition, for example, during engine idling.

The main fuel passage 9 is enlarged upwardly between the inlet 12 of the slow fuel passage 11 and the second blind end. In the embodiment herein described, the upwardly enlarged portion 18 is formed as a cylindrically enlarged portion, the longitudinal axis of which coincides with that of the main fuel passage 9. To an upper wall of the cylindrically enlarged portion 18, an inlet port 19 of the fuel vapor conduit 20 is open. The inlet port 19 is formed in a T-shape. One lateral extension of the T-shaped inlet port 19 is connected to the fuel vapor conduit 20 through a vapor jet 21, and the other lateral extension is connected to the atmosphere through an air jet 22. An outlet 23 of the fuel vapor conduit 20 is open to the intake passage 2 at the venturi section 2'.

The above described variable venturi type carburetor operates as follows. When the engine is started, a vacuum is generated in the intake manifold. This vacuum is introduced into the vacuum chamber 7 through the suction port 6. Then the suction piston 4 is caused to move to the left, according to FIG. 1, so that the venturi area 2'formed between the leading edge 4' of the suction piston 4 and the inward elevation 5 of the body 1 is opened. Thus air flows through the intake passage 2. The degree of the venturi opening becomes large, since the vacuum in the vacuum chamber 7 connected to the venturi section 2' through the suction port 6 acts on the suction piston 4 when the amount of air flowing in the intake passage 2 is large and, thus, the vacuum in the venturi section 2' becomes large. The degree of the venturi opening becomes small when the amount of air in the intake passage 2 is small. Therefore, the suction piston 4 moves in the intake passage 2 in response to an increase or a decrease of the amount of air flowing in the intake passage 2, so that the flow area in the intake passage 2 or venturi opening varies until the vacuum in the venturi section 2' becomes a predetermined almost constant pressure.

When a car fitted with the variable-venturi-type carburetor is being driven, the degree of suction piston 4 movement is great, since the amount of air flowing in the intake passage 2 is large. Therefore, the metering needle 8, fixed onto the suction piston 4, moves to the left, according to FIG. 1. As the external diameter of the needle 8 becomes smaller toward the free end, an annular gap between the metering jet 10 and the needle 8 becomes larger in this state; therefore, more fuel is fed to the intake passage 2 through the jet 10.

When the car is idling, the amount of air flowing in the intake passage 2 is small and the suction piston 4 moves to the right, according to FIG. 1, together with the needle 8. In this state, a very small amount of fuel flows through the jet 10. However, this does not contribute to the engine revolution but only to wet walls of suction piston 4 and intake passage 2. Fuel, necessary for keeping the engine operating, is fed only through the slow fuel passage 11. Fuel, enters from the inlet 12, is metered by the slow jet 13, is mixed with air which flows through the air bleed passage 14, and is discharged in the intake passage 2 from the outlet 15.

In order to set the air-fuel ratio lean during engine idling, it is necessary to have a relatively small internal diameter of the slow fuel passage 11, namely that of the slow jet 13. In such an arrangement, however, the continuous fuel flow through the relatively small slow jet 13 may be interrupted if fuel vapor leaks into or forms in the main fuel passage 9 when the engine is caused to idle after being driven at a high load, as described hereinbefore, and because the temperature becomes higher because of less fuel flowing during idling. Thus, the air-fuel ratio becomes excessively lean in step-type pulses, which causes the engine to rotate unstably or to stall.

Figure 2:
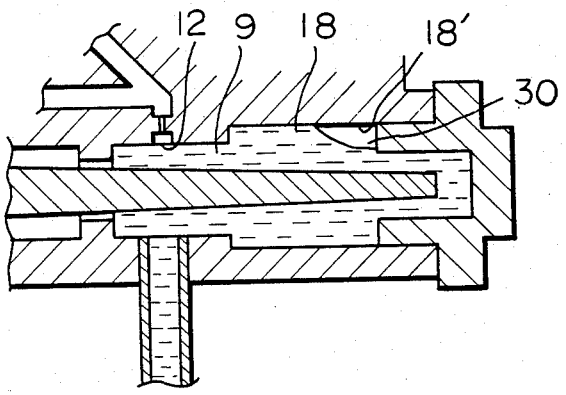
FIGS. 2 and 3 show enlarged, schematic sectional views illustrating the location and the process of fuel vaporising.
Figure 3:
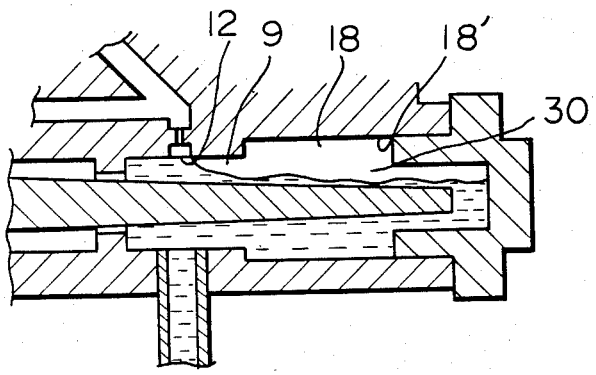

FIGS. 2 and 3 illustrate the location and the process of fuel vaporising, if the carburetor had no fuel vapor conduit according to the invention. When the engine is idling, fuel flows through the slow fuel passage 11. This fuel flow is relatively small compared to that of the driving condition; however, fuel flows slower near the second blind end in the main fuel passage, so that the temperature tends to become higher at that area. Therefore, fuel vaporization occurs at the position 30 in FIG. 2. The fuel vapor then spreads along the upper wall 18' of the main fuel passage 9, as is understood by referring to FIGS. 2 and 3. Finally, the fuel vapor reaches the inlet 12 of the slow fuel passage 11 and is introduced into the slow fuel passage 11.

According to the present invention, the main fuel passage 9 is enlarged upwardly, in the illustrated case, by providing an enlarged cylindrical portion 18 in the main fuel passage; therefore, fuel vapor in the main fuel passage 9 collects along the upper wall 18' of the cylinder portion near the second blind end, as illustrated in FIG. 2.

According to the invention, collected fuel vapor is introduced into the inlet port 19 of the vapor conduit 20, as illustrated in FIG. 1. This fuel vapor is carried from the inlet port 19 to the intake passage 2 through the fuel vapor conduit 20 by a flow which is caused by the pressure difference between the atmospheric pressure through the air jet 22 and the vacuum in the intake passage 2.

The above flow through the fuel vapor conduit 20 carries the fuel vapor only, after it is separated from the liquid fuel, since the vacuum which acts on the liquid fuel is reduced by the atmospheric pressure through the air jet 22. In the illustrated case, the outlet 23 of the vapor fuel conduit 20 is open to the intake passage 2 at the position where the suction piston 4 operates to generate an almost constant vacuum, so that the pressure difference between the inlet and outlet of the fuel vapor conduit 20 is almost constant. This is very convenient for setting the internal diameters of the vapor jet 21 and air jet 22 so as to allow only the fuel vapor to flow in the fuel vapor conduit 20, without having the fuel vapor flow into the slow fuel conduit 11.

What is claimed is:

1. A variable-venturi-type carburetor having an intake passage therethrough; a suction piston movable in the intake passage; a substantially horizontally extending main fuel passage having a first end and a second blind end, said second blind end located at a position in said main fuel passage opposite to said first end; a metering jet arranged adjacent to the first end of said main fuel passage for interconnecting the main fuel passage to the intake passage; a slow fuel passage having a fuel inlet which is open to the main fuel passage near said metering jet, said slow fuel passage having a fuel outlet which is open to the intake passage; a metering needle fixed onto the suction piston and extending into the metering jet for metering fuel fed into the intake passage from the main fuel passage; said main fuel passage having a vertically enlarged portion formed between the inlet of the slow fuel passage and the second blind end; a fuel vapor conduit, said fuel vapor conduit having a fuel vapor outlet which is open to the intake passage; and an upwardly oriented, T-shaped inlet port for said fuel vapor conduit, said inlet port being open to the main fuel passage at said vertically enlarged portion, one lateral port of said T-shaped inlet port being connected to the fuel vapor conduit, the other lateral port being connected to atmospheric pressure.

2. A carburetor according to claim 1, wherein each lateral port has a respective jet to restrict the flow in the fuel vapor conduit, the internal diameters of each said jet being selected so as to allow only the fuel vapor to flow in the fuel vapor conduit.

* * * * *